US006408632B1

(12) United States Patent
Cashin

(10) Patent No.: US 6,408,632 B1
(45) Date of Patent: Jun. 25, 2002

(54) FREEZER AND PLANT GAS SYSTEM

(76) Inventor: Michael D. Cashin, 333 S. Indiana St., Anaheim, CA (US) 92805

( * ) Notice: Subject to any disclaimer, the term of this patent is extended or adjusted under 35 U.S.C. 154(b) by 0 days.

(21) Appl. No.: 09/605,770

(22) Filed: Jun. 28, 2000

(51) Int. Cl.[7] ..... F25B 19/00
(52) U.S. Cl. ..... 62/51.1; 62/78
(58) Field of Search ..... 62/64, 78, 51.1

(56) References Cited

U.S. PATENT DOCUMENTS

| | | | | |
|---|---|---|---|---|
| 2,246,875 A | | 6/1941 | Carney | 62/1 |
| 2,359,219 A | * | 9/1944 | Jones | 62/50.2 |
| 2,535,364 A | | 12/1950 | Lee | 62/1 |
| 2,580,710 A | | 1/1952 | Wildhack | 62/1 |
| 2,610,471 A | | 9/1952 | Thayer | 62/1 |
| 2,687,021 A | | 8/1954 | Mattison | 62/115 |
| 2,755,639 A | * | 7/1956 | Straznicky | 62/7 |
| 3,007,319 A | * | 11/1961 | Ogden | 62/64 |
| 3,307,366 A | * | 3/1967 | Smith | 62/50.1 |
| 3,315,480 A | * | 4/1967 | Rich | 62/63 |
| 3,421,336 A | | 1/1969 | Lichtenberger et al. | 62/45 |
| 3,662,561 A | * | 5/1972 | Schroeder | 62/50.2 |
| 3,705,500 A | | 12/1972 | Jehle | 62/223 |
| 3,729,948 A | * | 5/1973 | Schwartz | 62/64 |
| 4,137,723 A | * | 2/1979 | Tyree, Jr. | 62/64 |
| 4,332,136 A | * | 6/1982 | Quack | 62/48.2 |
| 4,621,500 A | | 11/1986 | Pagani et al. | 62/45 |
| 4,739,622 A | * | 4/1988 | Smith | 62/78 |
| 5,267,446 A | | 12/1993 | Viegas et al. | 62/50.2 |
| 5,373,701 A | | 12/1994 | Siefering et al. | 62/48.1 |
| 5,571,231 A | | 11/1996 | Lee | 62/48.2 |

OTHER PUBLICATIONS

Industrial Heating, The International Journal of Thermal Technology; The Industry Leader of Cryogenic Processing (Circle #13); CSZ Cincinnati Sub–Zero (Circle #17); Webber Cryogenic Freezers (Circle #20); Cincinnati Sub–Zero (Circle #186); and 300 Below Inc.—CryoTech (Circle #188) pp. 21, 28, 33, and 71, Feb. 2000.

* cited by examiner

*Primary Examiner*—Ronald Capossela
(74) *Attorney, Agent, or Firm*—Lyon & Lyon LLP

(57) ABSTRACT

An improved freezer and plant gas system that harnesses the cooling properties of the plant gas evaporator to facilitate energy and cryogen savings, as well as the automation and optimization of a plant thermal processing system. The freezer preferably includes an internally mounted evaporator sized to meet the gas requirements of the plant processes requiring inert gas. By evaporating the plant gas in the freezer, the freezer can be remotely located from the liquid cryogen source while still making liquid cryogen available when called for during a cryogenic treatment process metal or other materials. In addition, by evaporating in the freezer the freezer is able to harness the cooling properties of the evaporator to pre-cool the freezer and material prior to use of liquid in the cooling cycle. Alternatively, a liquid load basket is adapted to economically thermally treat materials in a deep cryogenic treatment.

5 Claims, 4 Drawing Sheets

FREEZER AND PLANT GAS SYSTEM

FIELD OF THE INVENTION

The present invention relates generally to freezers for cryogenic treatment of metals and other materials and, more particularly, to a freezer and plant gas system that harnesses the cooling properties of the plant gas evaporator in a manner that facilitates energy and cryogen savings, as well as, thermal processing automation and optimization.

BACKGROUND OF THE INVENTION

Recently, substantial attention has been drawn to cryogenic treatment of metal parts and tools. The cryogenic treatment process tends to enhance a metal's mechanical properties such as wear resistance, hardness, and dimensional stability. Manufacturing companies, which replace thousands of worn out tools every year at a tremendous cost to the company and the consumer, are turning to cryogenic treatment processes in growing numbers in an effort to increase tool life and reduce costs. Use of the cryogenic treatment process has also found its way into high performance applications and consumer type products. For instance, cryogenic treatment processes are used to enhance the performance and durability of auto racing cars, the accuracy of firearms, the performance of baseball bats and golf clubs, the tonal quality of musical instruments, and the accuracy of aeronautical measuring devices. It also plays an integral part in the construction of satellites, interplanetary probes, and ground and space based telescopes. Other areas in which the cryogenic treatment process is being used include the fields of medicine, genetics, and semiconductors.

The cryogenic treatment process typically includes the use of liquid cryogen, such as nitrogen or some other inert gas, to significantly cool parts or specimens well below zero degrees Fahrenheit (F); in some instances, all the way down to minus 320° F. The cooling is typically accomplished in a "cold box" or insulated freezer compartment supplied with a liquid cryogen from a liquid storage tank.

Most facilities with freezer installations also include plant processes, such as heat treating, that utilize inert gas. To supply gas to these processes, evaporators, which enables the liquid cryogen to expand to gas, are installed near the liquid storage tank, usually on the same pad and typically in "free air" to take advantage of maximum heat exchanging properties. A drawback to placing the evaporators in "free air" is that a significant amount of cooling energy is unnecessarily wasted. Harnessing this energy could prove to be advantageous to overall plant processes and economics.

Another drawback to established freezer installations is the location of the freezer. Typically, the freezer is installed in the immediate vicinity of the liquid storage tank to ensure liquid is available in a reasonable amount of time when called for in the cooling process. This location may be a significant distance from the location most beneficial to the overall process and economics of a plant. For example, in heat treatment facilities, it may be desirable to locate the freezer on the other side of the-plant within an automated thermal processing line, which would allow an operator to include heat treatment and cryogenic treatment in the treatment "recipe" for a given part or tool. However, the farther the freezer is located away from the liquid storage tank, the less efficient the freezer system will operate.

The inefficiency of the freezer system is due to the expansion of the liquid cryogen to gas within the liquid supply conduit. Specifically, the liquid cryogen will expand into gas in the conduit in which it is transported until the conduit itself is cooled below the temperature at which the cryogen will liquefy or stay in liquid form. The farther the freezer is away from the liquid source, the more gas that will evaporate and expand in the conduit and be wasted in the freezer, until the conduit is cooled and liquid reaches the freezer. Because freezer use is intermittent in most freezer installations, the liquid cryogen will typically re-expand along the conduit as the freezer and conduit warm between cooling processes. As a result, significant quantities of gas will likely be wasted upon each use of the freezer.

One way to combat this waste is to locate the freezer in the immediate vicinity of the liquid storage tank. But as noted above, this requires locating the freezer remotely from the designed heat/cryogenic treatment process and, thus, creates excessive labor costs due to material handling and transportation to and from the balance of the process. Alternatively, a cryogenic pumping system could be used to provide constant pressure to prohibit expansion of the liquid cryogen to gas in the piping system. However, such systems tend to be very costly to purchase and install, as well as, operate and maintain.

Thus, it would be desirable to provide a freezer and plant gas system in which the freezer can be located remotely from the liquid storage tank, wherein liquid is supplied to the freezer on demand without excessive wasting of gas, and wherein the cooling energy of the plant gas evaporation process can be harnessed.

SUMMARY OF THE INVENTION

The present invention is directed to an improved freezer and plant gas system that harnesses the cooling properties of the plant gas evaporator to facilitate energy and cryogen savings, as well as the automation and optimization of a plant thermal processing system. In a particularly innovative aspect of the invention, the freezer includes an internally mounted evaporator sized to meet the gas requirements of the plant processes requiring inert gas. By evaporating the plant gas in the freezer, the freezer can be remotely located from the liquid cryogen source while making liquid cryogen available when called for during a cryogenic treatment process of metal and other materials. In addition, by evaporating in the freezer the freezer advantageously harnesses the cooling properties of the evaporator to pre-cool the freezer and material to be treated prior to any use of liquid cryogen in the cooling process; resulting in significant cryogen and energy savings.

In another innovative aspect of the invention, a liquid load basket is adapted to economically thermally treat materials in a deep cryogenic treatment process.

Other innovative aspects of the invention include the preceding aspects individually or in combination.

Other aspects and features of the present invention will become apparent from consideration of the following description taken in conjunction with the accompanying drawings.

DETAILED DESCRIPTION OF PREFERRED EMBODIMENTS

Figure 1:
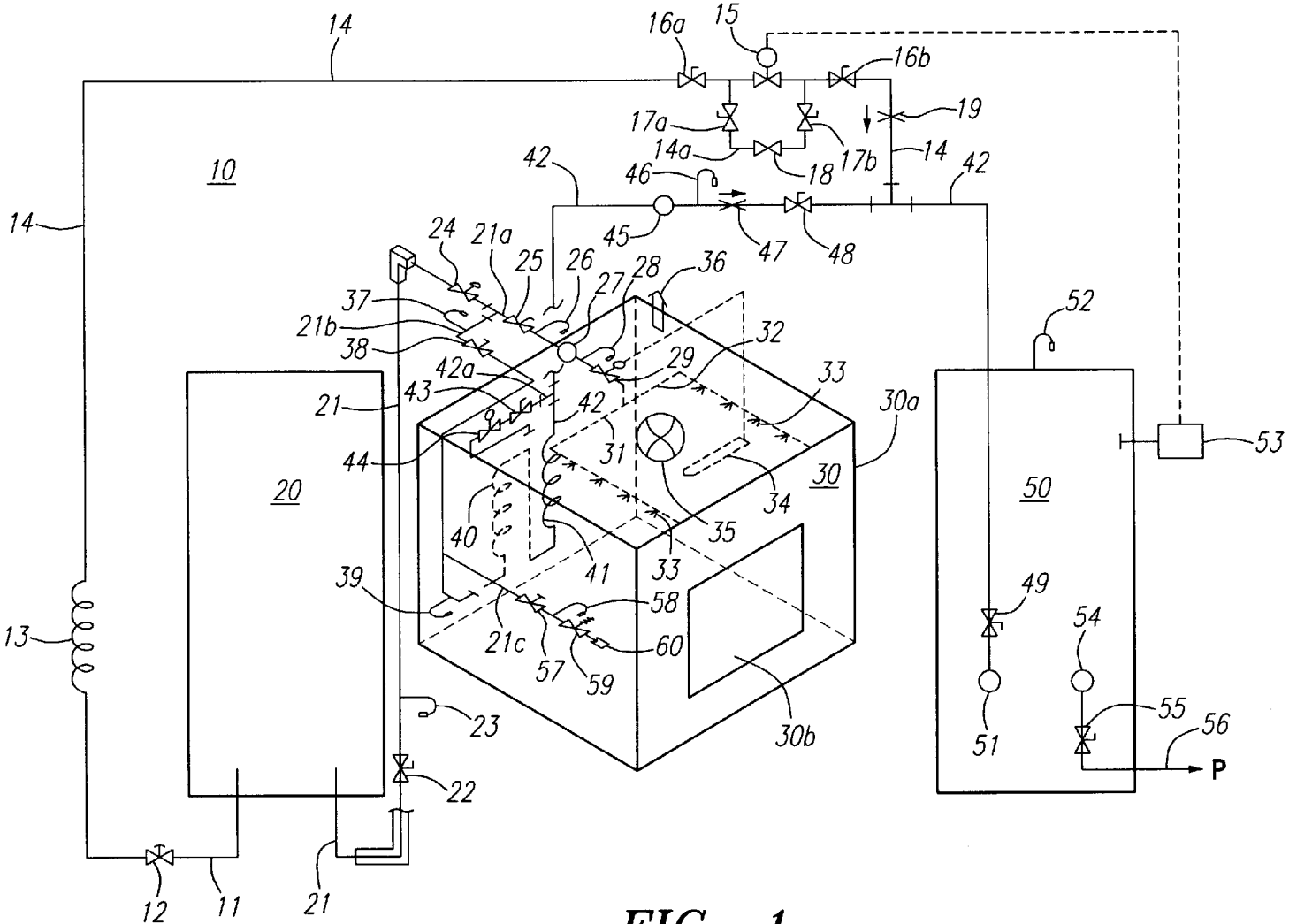
FIG. 1 is a schematic of the plant gas system of the present invention with an isometric view of a cryogenic freezer of the present invention.

Referring to FIG. 1, a plant gas system 10 of the present invention is shown. The plant gas system 10 includes a liquid storage tank 20 filled with a liquid cryogen, such as nitrogen, argon, or other liquid cryogen, a freezer 30 with an internally mounted plant gas evaporator 40, and a plant gas reservoir 50. In operation, liquid cryogen flows from the storage tank 20 into the freezer 30 to be used in a cryogenic treatment process and separately flows through the evaporator 40 where it is evaporated or expanded into gas. The expanded gas flows into the reservoir 50 and from there it is supplied to plant processes that utilize inert gas. By evaporating inside the freezer 30, the plant gas system 10 of the present invention advantageously captures the cooling energy of the evaporator 40 that is normally lost in established plant gas methods, and economically and efficiently transports liquid cryogen over long distances.

Although most thermal processing plants have a sizeable inert gas usage for vacuum furnaces, nitrating furnaces, hardening furnaces, etc., only nominal plant gas usage, such as the introduction of vaporized inert gas into the plant's pneumatic system, is needed to cause liquid cryogen to flow to the plant gas evaporator 40 within the freezer 30 where it is expanded into gas. As a result, liquid cryogen tends to be immediately available when called for in the cooling process. More particularly, liquid cryogen tends to be available without having to expel and, therefore, waste significant quantities of warmer gas as the conduit cools to temperatures necessary to liquefy the cryogen. In addition, the cooling properties of the evaporator 40 advantageously pre-cool the freezer 30 and material to be processed prior to the use of any liquid cryogen. Depending on a plant's gas usage, the freezer and material can be pre-cooled to temperatures ranging from about minus 80° F. to about minus 150° F., and possibly lower. Accordingly, there tends to be substantial savings in the amount of liquid cryogen used during the cooling process. The amount of energy in BTU's that it takes to cool the freezer components and material to a desired temperature illustrates that the pre-cooling process saves a significant amount of liquid cryogen.

For example, the amount of energy (Q) in BTUs that it takes to cool the a load of material can be calculated as follows:

$$Q=M\times S\times \text{DELTA-T}$$

wherein,

Q=Heat removed in BTU's

M=Mass in pounds (#s) of material to be cooled

S=Specific heat of material in BTU's/#/° F.

DELTA-T=Temperature differential between ambient temperature, which in heat treating facilities is typically 20° F. higher than outside temperatures, and the temperature to which the internal evaporator will cool the freezer compartment, freezer components, and the material to be processed.

For this calculation, the material and components to be cooled include a 1,000 # load of steel (S=0.12), a stainless steel (S=0.12) freezer load basket with associated components weighing approximately 180#s, and a stainless steel freezer inner wall assembly weighing approximately 350#s. Assuming an ambient temperature of 80° F., and a pre-cooled temperature of minus 100° F., Delta-T=180° F.

$Q_{Load}=M_L\times S_L\times \text{Delta-T}=1{,}000\times 0.12\times 180=21{,}600$ BTU's $Q_{Basket}=M_B\times S_B\times \text{Delta-T}=180\times 0.129\times 180=3{,}532$ BTU's $Q_{wall}=M_w\times S_w\times \text{Delta-T}=350\times 0.129\times 180=6{,}867$ BTU's $Q_{Total}=31{,}999$ BTU's According to this example, pre-cooling would save the amount of liquid cryogen necessary to generate 32,000 BTU's of cooling energy.

In addition to these savings, evaporating within the freezer 30 allows the freezer 30 to be located anywhere within the plant and preferably where it would be most beneficial to the overall process. More particularly, the ability to locate the freezer in the area of the plant where the balance of the before-and after-freezing processes are performed, enables a system operator to include freezing in the "recipe" for automated and semi-automated systems. This tends to create considerably savings in time and labor cost due to material handling. For instance, locating the freezer within the balance of heat treating equipment allows the same alloy baskets to be used for the hardening furnace, the washer, the tempering furnace and the freezer. Substantial savings in time and labor cost result from not having to transfer material from one basket to another, and back again, and from not having to transport material from the heat treatment line to the freezer, and back again.

As noted above, by evaporating in the freezer compartment, liquid cryogen tends to be immediately available at the freezer location. This enables better and more stable control of the temperature in the freezer compartment compared to a system that would first produce warmer gas, then liquid, each time the process calls for cooling. Freezer controls normally include an analogue input temperature control system utilizing a PID (proportional-integral-derivative algorithm) loop to open and close a cryogenic solenoid valve or actuate a motor operated valve (MOV) to control the flow of liquid into the insulated freezer compartment. In previous systems, when the PID control calls for cooling it will first encounter warm gas, then liquid. In response, the PID control is likely to over-react as the higher temperature gas being expelled almost instantaneously turns to the considerably lower temperature liquid. By encountering liquid from the outset, a control system employed with the freezer 30 of the present invention will tend to perform more efficiently and be more stable as the system acquires and maintains a desired temperature set point.

Figure 2:
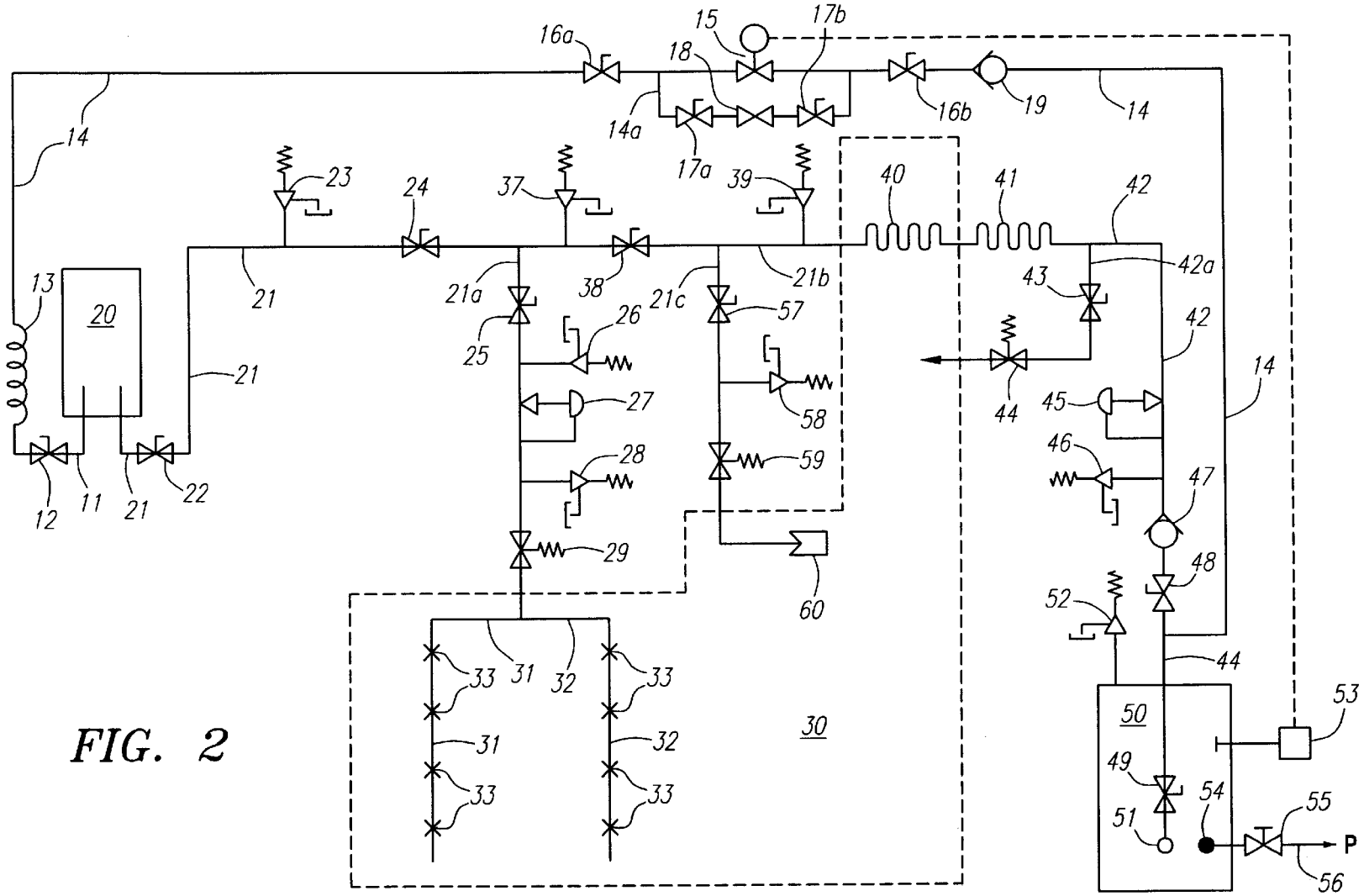
FIG. 2 is a piping schematic of the plant gas system of the present invention shown if FIG. 1.

Referring in detail to FIGS. 1 and 2, the freezer 30 and plant gas system 10 of the present invention comprises a liquid cryogen storage tank 20 having primary 21 and secondary 11 liquid conduit lines extending therefrom. The liquid storage tank 20 stores gases such as nitrogen, argon, oxygen, helium, or others, or combinations thereof, in liquid form. Cryogenic globe valves 12 and 22 are installed along the liquid conduit lines 11 and 21 adjacent the storage tank 20 to isolate the tank 20 while it is being filled, repaired, or replaced. Located adjacent the storage tank 20 along secondary line 11 is a tertiary or backup evaporator 13, which is normally exposed to ambient conditions as in typical plant gas systems. A secondary plant gas supply line 14 extends from the tertiary evaporator 13 and joins a primary plant gas line 42, which feeds into a gas reservoir 50. A dual pressure switch 53 on the reservoir 50 causes a solenoid valve 15 in the secondary plant gas line 14 to open and close depending on the gas pressure in the reservoir 50. Preferably the solenoid valve will open when the pressure in the reservoir 50 goes below 80 pounds and will close when the pressure in the reservoir 50 raises above 95 pounds. The solenoid valve 15 is preferably a normally opentype solenoid valve to ensure plant processes have sufficient gas in the event of a power outage. A pair of isolation ball valves 16*a* and 16*b* is located on either side of the solenoid valve 15 to isolate the solenoid valve 15 for repair or replacement. A check valve 19, preferably a swing back type with a Teflon seat, is located along the secondary gas line 14 after the solenoid valve 15. The check valve 19 prevents back flow of gas from the primary plant gas line 42 along the secondary the plant gas line 14 toward the liquid storage tank 20.

A pressure by-pass line 14*a* branches around the solenoid valve 15 and includes a pressure actuated valve 18 and a pair of isolation ball valves 17*a* and 17*b* located on both sides of the pressure actuated valve 18. As the gas pressure builds up in the liquid storage tank 20 from the evaporation of the liquid cryogen, a pressure relief valve (not shown) would typically vent the gas from the tank 20 into the atmosphere. The bypass line 14*a* and valve 18 combat this wasteful method by advantageously allowing the gas to be flow into the gas reservoir 50.

The primary liquid cryogenic supply line 21 extends from the liquid storage tank 20 to a freezer 30 of the present invention. The freezer 30 preferably includes an enclosure 30*a* having a door 30*b* that is opened to insert material for cryogenic treatment, an internally mounted evaporator 40, a series of sprayer nozzles 33, a flapper vent 36 to exhaust gas during the cooling process, and a fan 35 to uniformly circulate the cool gas. The freezer enclosure 30*a*, which is generally box-like, preferably includes an external steel plating weldment and an internal stainless steel plating weldment. A load rack formed of three inch stainless steel tubing and rollers is preferably included adjacent the base of the enclosure. A pressure actuated ball-type drain closure is located in the floor of the enclosure to allow liquid to drain after the cooling process. A hydraulic cylinder preferably drives the door 30*b* of the enclosure 30*a*. Alternatively, the door 30*b* could be driven by a pneumatic cylinder or a chain and roller type assembly. The design of the load rack and internal mechanical roller assembly, along with the external features, esthetic, mechanical or otherwise, are such that they can be altered or customized to accommodate different manufacturers preferences and/or requirements.

Because liquid cryogen flows to the freezer's internal evaporator 40, where it is evaporated into gas for plant processes, the liquid cryogen is economically and efficiently transported over long distances and still made available for immediate use when called for during the cooling process. As a result, the freezer 30 can advantageously be placed remotely at distances well over 400 feet away from the liquid storage tank 20. Depending on the gas usage of plant, it may be possible to efficiently operate the freezer/plant gas system with minimal insulation around the liquid cryogenic supply line 21 and still maintain liquid flowing through the supply line 21 to the freezer 30. However, it may be economically desirable to vacuum jacket the supply line 21 to ensure that the freezer 30 harnesses the maximum amount of available cooling energy.

The liquid supply line 21 branches off adjacent the freezer 30 to sprayer and evaporator feed lines 21*a* and 21*b*. Prior to branching off to the separate feed lines 21*a* and 21*b*, the liquid supply line 21 includes a cryogenic ball valve 24 to isolate the freezer 30 for maintenance, repairs, or replacement. A 350 psi pressure relief valve 23 is preferably located along the liquid supply line 21 between isolation valves 22 and 24.

Inside the freezer compartment 30*a*, the sprayer feed line 21*a* branches into two sprayer feed arms 31 and 32. A series of spiral cone type spray nozzles 33 are connected to the feed arms 31 and 32. The feed arms 31 and 32 and sprayer nozzles 33 are mounted along with the fan 35 adjacent the ceiling of the freezer compartment 30*a*. As liquid cryogen is sprayed from the nozzles 33, the fan 35 is operated to uniformly circulate cool gas around the material being treated. Prior to entering the freezer compartment 30*a*, the sprayer feed line 21*a* includes a cryogenic ball valve 25, a pressure regulator 27, which prevents the freezer compartment 30*a* from becoming over pressurized during the cooling process, a solenoid valve 29, which controls the flow of liquid cryogen to the spray nozzles 33 located on feed arms 31 and 32, and a pair of pressure (350 psi) relief valves 26 and 28 preferably located between the isolation valve 25, the pressure regulator 27 and the solenoid valve 29. The freezer 30 preferably includes an analogue input temperature control system with a PID loop that includes a temperature control switch 34. The temperature control switch 34 actuates the solenoid valve 29 between open and closed positions to control the flow of liquid cryogen to the spray nozzles 33. Alternatively, the controller may be programmed to utilize an analog output in order to variably control a MOV valve that could be used in place of solenoid valve 29 to control the flow of liquid to the spray nozzles 33.

The evaporator feed line 21*b* includes a cryogenic ball valve 38 prior to entering the freeze compartment 30*a*. Pressure (350 psi) relief valves 37 and 39 are preferably located between isolation valves 24, 25 and 38, and between isolation valve 29 and the internal evaporator 40. The internal evaporator 40 is preferably mounted on the back interior wall of the freezer compartment 30*a*. Alternatively, the evaporator 40 could be mounted on either side wall or ceiling of the freezer compartment 30*a*, or may comprise two (2) or more internal evaporators connected in series or parallel within the freezer compartment 30*a*. The internal evaporator 40, which operates as the primary plant gas evaporator for the plant gas system 10 of the present invention, is preferably connected in series to an externally mounted secondary evaporator 41. Both evaporators are preferably sized at 125% of plant gas capacity. As the temperature within the interior of the freezer compartment 30*a* decreases, the primary/internal evaporator 40 becomes less and less efficient resulting in liquid cryogen flowing out of internal evaporator 40 into the external/secondary evaporator 41. The secondary/external evaporator 41 is utilized to evaporate any liquid cryogen that exits the primary/internal evaporator 40.

A primary gas line 42 extends from the external evaporator 41 to the gas reservoir 50. Prior to the reservoir 50 and a junction with the secondary gas line 14, the primary gas line 42 includes a pressure regulator 45, a check valve 47, an isolation ball valve 48, and a pressure (350 psi) relief valve 46 preferably located between the pressure regulator 45 and the isolation valve 48. The pressure regulator 45 preferably prevents liquid cryogen from being pumped into the reservoir 50, while the check valve 47, which is preferably a swing back type with a Teflon seat, preferably prevents back flow of gas from the secondary gas line 14. Another isolation valve 49 is located along the primary gas line 42 after the junction with the secondary gas line 14 and prior to a gas inlet 51 on the reservoir 50. The reservoir 50 includes a pressure relief valve 52 and a gas outlet 54. Another isolation valve 55 is located on the plant gas line 56, which feeds gas to the plant processes that utilize inert gas.

A blanket gas line 42*a* preferably extends from the primary gas line 42, just after the external evaporator 41, back into the freezer 30. The blanket gas system is activated when the freezer door 30*b* is opened and creates a positive gas pressure in the freezer compartment 30*a*. The positive gas pressure tends to prevent ambient air from entering the freezer 30 and causing the internal evaporator 40 and other components to ice up. The blanket gas line 42*a* includes an isolation ball valve 43 and a solenoid valve 44, which is actuated by a blanket gas control switch that is triggered by the opening of the freezer door 30*b*.

In operation, plant gas is drawn off of the reservoir 50 through the reservoir outlet 54 causing the cryogen to flow in gas form through the liquid supply line 21, the primary and secondary evaporators 40 and 41, and the primary gas line 42 into the gas reservoir 50, until the liquid supply line 21 cools to a temperature at which the cryogen remains a liquid. Once cryogen is flowing in liquid form through the liquid supply line 21 to the freezer 30, it will flow through the internal primary evaporator 40 where it will expand into gas for the plant processes. The cooling properties of the internal primary evaporator 40 are harnessed by the freezer 30 to pre-cool the freezer compartment 30*a* to approximately minus 100° F. As the interior of the freezer compartment 30*a* becomes too cold for the primary evaporator 40 to effectively evaporate the liquid to gas, the secondary external evaporator 41 performs the necessary evaporation. By evaporating remotely at the freezer 30, liquid tends to be immediately available when called for during the cooling process.

To begin the cooling process, the door 30*b* of the freezer 30 is opened to insert the material to be treated. Opening the door 30*b* triggers the solenoid 44 in the blanket gas line 42*a* to open and feed blanket gas into the interior of the freezer compartment 30*a*. The blanket gas creates a positive pressure within the freezer compartment 30*a* and, thus, prevents ambient air from entering the freezer compartment 30*b*. A load of material to be processed is then manually loaded, or loaded as part of an automated or semi-automated thermal processing line, into the freezer 30. Once loaded, the freezer door 30*b* is shut and the blanket gas solenoid 44 closes.

The material is then pre-cooled to a desired temperature or for a desired amount of time by using a pre-cool timer or a thermostat, which can be used to initiate the cooling cycle. Once the material has cooled to a desired temperature, such as minus 100° F., or for a desired period of time, a temperature set-point is read by or entered into the control system. The temperature control switch 34 actuates the sprayer solenoid valve 29 to enable liquid cryogen to flow to and out of the spray nozzles 33. The circulation fan 35 is also activated to uniformly distribute the cool gas around the material. As the temperature within the freezer compartment approaches the set-point temperature, the temperature control switch 34 modulates the sprayer solenoid valve 29 to acquire and maintain the set-point temperature. The material will be cooled at the set-point temperature for an appropriate amount of time to obtain the desired mechanical properties for the material being treated. After the treatment process is completed, the freezer door 30*b* is opened and the blanket gas system activated.

The control system includes a purge mode that enables a person to safely enter the freezer 30 and work on its internal components. The purge system will only work when the freezer door 30*b* is open. When activated, the purge system disables the liquid cryogen supply to the spray nozzles 33 by closing the sprayer solenoid valve 29, disables the blanket gas system by closing the blanket gas solenoid valve 44, and activates the fan 35 to vent any residual gas left in the freezer compartment 30*a*. The purge system preferably must be manually reset.

Figure 3:
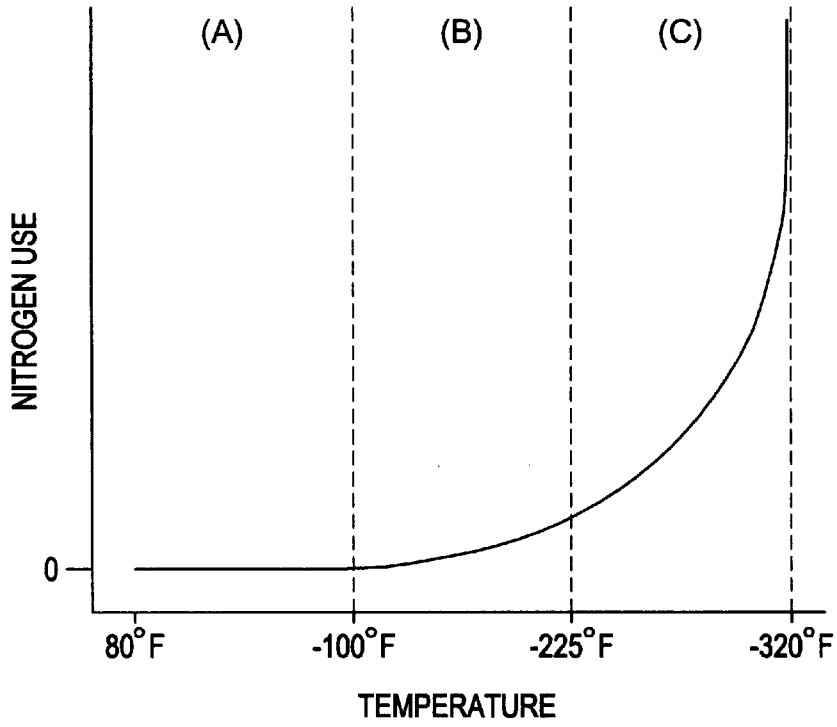
FIG. 3 is a graph showing liquid cryogen use of the freezer of present invention plotted against the temperature in degrees F reach inside the freezer.

Turning to FIG. 3, a graph is shown in which use of liquid cryogen by the freezer 30 is plotted against the temperature acquired in the freezer compartment 30*a*. As shown, the freezer 30 of the present invention does not use any liquid cryogen in a first or pre-cool temperature region (A) as the freezer 30 and material to be treated are cooled from an ambient temperature of approximately 800°F. to a pre-cooled temperature of approximately minus 100° F. In a second temperature region (B), which is between the pre-cooled temperature of approximately minus 100° F. and a transition temperature of approximately minus 225° F., liquid cryogen is sprayed from the nozzles 33 to further cool the freezer 30 and material. The freezer's 30 liquid cryogen use in this temperature region (B) appears to gradually increase as the temperature decreases. The increase in liquid cryogen usage per degree (F) change in temperature in this region (B) is relatively small until the temperature within the freezer 30 nears the transition temperature of approximately minus 225° F. The transition temperature is the temperature at which the freezer 30 tends to begin to use excess liquid for each degree (F) change in temperature. In the third temperature region (C), which includes temperatures at which deep cryogenic treatment is typically conducted, the freezer's liquid cryogen usage appears to increase exponentially for each degree (F) change in temperature as the temperature decreases from the transition temperature to approximately 320° F. While attempting to acquire and maintain a set-point temperature in this region (C), the spray nozzles 33 tend to approach operating at 100% capacity at 100% of the time.

Figure 4:
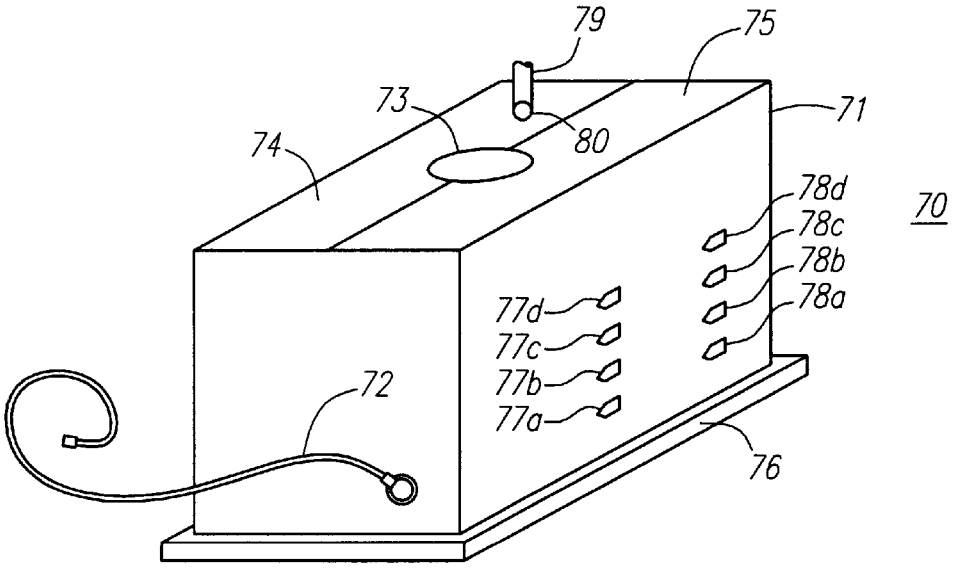
FIG. 4 is an isometric view of a liquid load basket of the present invention for use in deep cryogenic treatment processes.

To more economically accommodate the need for deep cryogenic treatment and avoid wasting liquid cryogen, the freezer 30 of the present invention preferably includes a liquid load basket 70. As shown in FIG. 4, the liquid load basket 70 includes a generally box-like enclosure 71 mounted on an alloy tray 76. The enclosure 71 includes an opening 73 at its top to vent expanding gas. The top of the enclosure 71 includes a pair of hingedly connected doors 74 and 75. Mounted within the enclosure 71 are a series of liquid cryogen level detecting thermocouples 77*a–b* corresponding to levels 1–4, and a series of off-set level detecting thermocouples 78*a–d* corresponding to off set levels 1–4. The basket 70 also includes a liquid feed line or connector 72 to fill the basket 70 with liquid cryogen. The feed line 72 includes a flexible hose with a twist lock type adapter for manual or semi-automatic systems, or a male or female quick disconnect spline-type coupler for fully automatic systems. Although the load basket feed line 72 is connectable to a liquid load connector 60 in the freezer 30, and the liquid load basket 70 is preferably used in conjunction with the freezer 30, it is also directly connectable to a source of liquid cryogen.

As shown in FIG. 2, the liquid load connector 60 is located at the end of a liquid load feed line 21*c*, which branches off of the liquid supply line 21. The liquid feed line 21*c* includes an isolation ball valve 57, a solenoid valve 59, and a pressure (350 psi) relief valve 58 positioned there between.

In operation, the material to be processed by deep cryogenic treatment is placed within the liquid load basket 70. The operator determines at which level the material will be completely submerged in the liquid cryogen and programs the desired level into the control system. The freezer door

30*b* is opened and the blanket gas system is activated. The liquid load basket 70 is placed inside the freezer 30 and coupled to the connector 60 on the liquid load feed line 21*c* of the freezer 30. Once the liquid load basket 70 is inside the freezer 30, the door 30*b* closes and the blanket gas is shut off by closing the blanket gas solenoid valve 44. The liquid load basket 70 is pre-cooled to a desired temperature or for a desired period of time in a manner discussed above. Once the pre-cool temperature is reached or the time runs out, a set point temperature, which preferably equals a temperature that is slightly higher than the transition temperature, is read by or entered into the control system.

The temperature control switch 34 then actuates the sprayer solenoid valve 29 sending liquid cryogen to the spray nozzles 33 to acquire the desired set-point temperature within the freezer 30. As described, the material advantageously goes through two (2) steps of pre-cooling prior to being immersed in the liquid cryogen. The liquid cryogen usage within the liquid load basket 70 will tend to be lower than established methods as a result.

When the set-point temperature is reached, a fill control switch actuates the sprayer solenoid valve 59 to fill the liquid load basket 70 to a desired level. Assuming for exemplary purposes the set-point level is set at level 2, the control system will allow the basket 70 to fill with liquid until the level 2 off-set thermocouple 78*b*, senses a temperature equivalent to the liquid temperature of the cryogen, which is minus 320° F. for nitrogen, indicating that the liquid has reached the level 2 off-set. The fill control switch closes the solenoid valve 59 when the off-set thermocouple 78*b* senses the liquid temperature. The control system will maintain the liquid cryogen in the liquid load basket 70 at or above level 2 during the deep cryogenic treatment process by replenishing the liquid as it evaporates. More particularly, when the set-point thermocouple 77*b* senses a temperature above the liquid temperature of the cryogen, e.g., minus 319° F. for nitrogen, indicating that the liquid level has fallen below the desired level, the fill control switch opens the solenoid 59 to fill the liquid load basket 70 with liquid cryogen until the off-set thermocouple 78*b* again senses the liquid temperature. After the treatment process is completed, the freezer door 30*b* can be opened to allow the liquid cryogen in the liquid load basket 70 to evaporate into the atmosphere.

Alternatively, the liquid load basket 70 may be completely enclosed and include an exhaust gas outlet 80 feeding a gas line 79, which may advantageously be coupled to a pneumatic gas system reservoir (not shown). In addition, in an attempt to reduce waste, the liquid load basket 70 may advantageously be connected via appropriate piping and valves to a liquid load recycle reservoir (not shown). During the deep cryogenic treatment process, evaporated gas is allowed to freely vent through gas outlet 80 and gas line 79 into the pneumatic gas reservoir. Once the treatment process is completed, a solenoid operated valve (not shown) in the pneumatic gas supply line 79 is closed. As the liquid cryogen in the liquid load basket 70 evaporates into gas, the pressure increases within the basket 70 to a level sufficient to force the remaining liquid cryogen out of the liquid load basket and into the liquid load recycle reservoir. Another solenoid valve (not shown) can be actuated to shut off access to the recycle reservoir when the control system senses that the liquid cryogen has been evacuated from the liquid load basket 70. The control system preferably includes programming logic that enables the liquid cryogen stored in the recycle reservoir to be used in a subsequent deep cryogenic treatment prior to drawing liquid from the liquid feed supply line 21*c*.

Other alternative embodiments to the present invention include using one gas or combination, for example, oxygen or helium or both, in liquid form, for pre-cooling, i.e., passing the liquid through the freezer's internal evaporator 40 where it is expanded into gas for other uses, and then using another gas or combination, such as nitrogen or argon or both, in liquid form for the cooling process.

Figure 5:
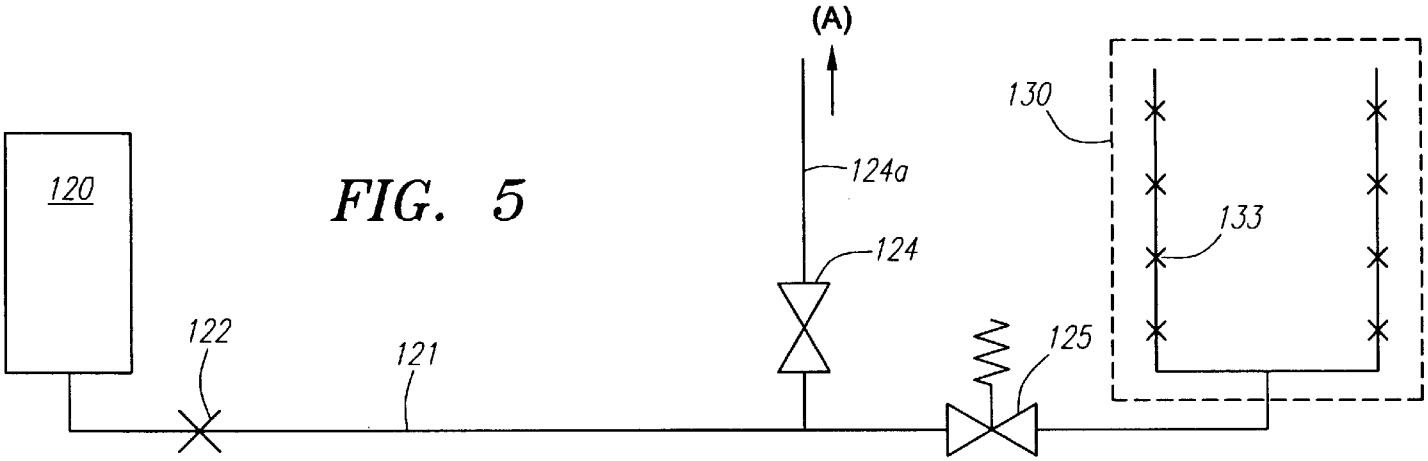
FIG. 5 is a piping schematic of a prior art freezer installation.

In another alternative embodiment, established freezer installations can be retrofitted to take advantage of the cooling properties of an evaporator and the liquid savings associated with evaporating inside the freezer. An established freezer installation 100, as shown in FIG. 5, typically includes a liquid storage tank 120, a supply conduit 121, and a freezer 130 with spray nozzles 133. An isolation valve 122 is located adjacent the tank 120 and a control valve 125 is installed in the supply line 121 prior to the freezer 130 to control the flow of liquid into the freezer 130. To ensure liquid is available at the freezer 130, a pressure actuated valve 124 is typically installed in the supply line 121 prior to the control valve 125. The pressure actuated valve 124 is used to vent gas from the supply line 121 to atmosphere (A) until the line 121 is sufficiently cool for liquid to flow. The valve 124 closes when liquid reaches the valve 124 to enable liquid to flow to the freezer 130.

Figure 6:
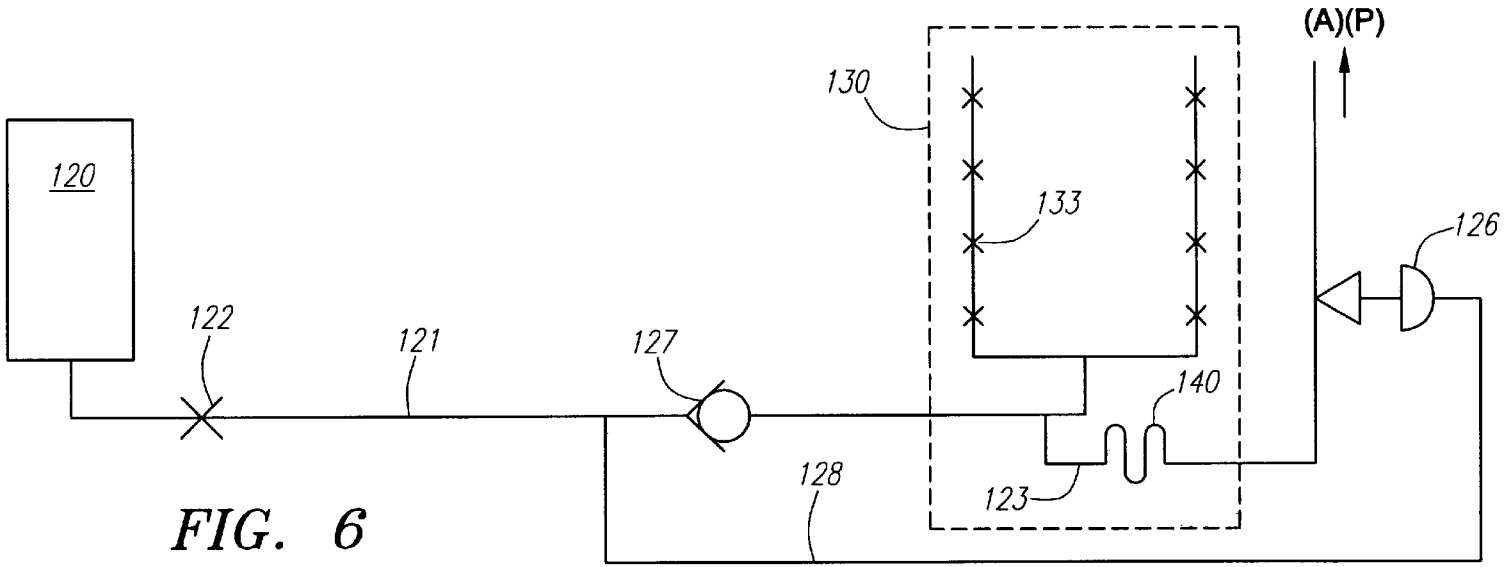
FIG. 6 is a piping schematic of an alternative embodiment of the plant gas system of the present invention.

Turning to FIG. 6, the pre-cooling benefits and some of the liquid savings of the present invention can easily be taken advantage of by retrofitting the existing installation of FIG. 5. The existing installation 100 can be retrofitted by removing the pressure actuated valve 124 and vent line 124*a* and installing an evaporator or heat exchange 140 within the freezer 130. An evaporator feed line 123 branches off of the supply line 121 and feeds liquid to the evaporator 140. After the liquid passes through the evaporator 140, the exiting gas can be vented to atmosphere (A) or to plant or pneumatic gas systems (P). A pressure regulator 126 can be used to vent gas around the evaporator 140 along a by-pass line 128 to exit side of the evaporator 140 until liquid flows through the supply line 121. A check valve 127 can be installed to prevent the back flow of gas.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A plant gas system comprising a liquid cryogen storage tank, a freezer comprising a first evaporator located within said freezer, said freezer and first evaporator being in communication with said liquid storage tank, a gas reservoir in communication with said first evaporator, and a second evaporator connected in series with said first evaporator, said second evaporator being located external to said freezer.

2. A plant gas system comprising a liquid cryogen storage tank, a freezer comprising a first evaporator located within said freezer, said freezer and first evaporator being in communication with said liquid storage tank, a gas reservoir in communication with said first evaporator, and second evaporator in communication with said liquid storage tank and said gas reservoir and bypassing said freezer.

3. A freezer for cryogenic treatment comprising an enclosure, an evaporator located within said enclosure, said evaporator being adapted to cool an interior of said enclosure and produce gas for plant processes, and a second evaporator connected in series with said evaporator and located external to said enclosure.

4. A freezer for cryogenic treatment comprising an enclosure, an evaporator located within said enclosure, said evaporator being adapted to cool an interior of said enclosure and produce gas for plant processes, and a liquid load basket comprising a chamber, a liquid inlet into the chamber, and a plurality of thermocouples internally mounted on the wall of said chamber, said plurality of thermocouples being vertically spaced apart.

5. The freezer of claim 4, wherein said liquid load basket further comprises a plurality of off-set thermocouples internally mounted on the wall of said chamber, said plurality of off-set thermocouples being vertically spaced apart.

* * * * *